United States Patent [19]

Smith

[11] 4,023,937

[45] May 17, 1977

[54] CHUCK ASSEMBLY

[75] Inventor: Geofrey Ian Smith, Skipton, England

[73] Assignee: Landis Lund Limited, Keighley, England

[22] Filed: Apr. 10, 1973

[21] Appl. No.: 566,773

Related U.S. Application Data

[63] Continuation of Ser. No. 390,248, Aug. 21, 1973, abandoned.

[52] U.S. Cl. ..... 51/237 CS

[51] Int. Cl.[2] ..... B24B 5/42

[58] Field of Search ..... 51/105 EC, 217 T, 237 CS, 51/238 R, 238 S, 238 GG; 269/20; 308/DIG. 1

[56] References Cited

UNITED STATES PATENTS

| | | | |
|---|---|---|---|
| 1,755,937 | 4/1930 | Steiner | 51/237 CS |
| 3,041,133 | 6/1962 | Hicks et al. | 269/20 X |
| 3,118,258 | 1/1964 | Price | 51/238.5 X |
| 3,583,108 | 6/1971 | Oishi et al. | 51/237 CS |
| 3,591,987 | 7/1971 | Porath | 51/238.5 X |
| 3,789,553 | 2/1974 | Johansson | 51/237 R |

FOREIGN PATENTS OR APPLICATIONS

| | | |
|---|---|---|
| 636,512 | 5/1950 | United Kingdom |
| 797,528 | 7/1958 | United Kingdom |
| 993,842 | 6/1955 | United Kingdom |
| 1,266,201 | 3/1972 | United Kingdom |

*Primary Examiner*—Harold D. Whitehead
*Attorney, Agent, or Firm*—Spencer T. Smith

[57] ABSTRACT

A chuck for rotatably supporting a bearing of a workpiece comprising a clamping fixture including a base member having a bearing surface selectively configured for matingly supporting a portion of the workpiece bearing, a jaw having a selectively configured bearing surface for matingly engaging with another portion of the workpiece bearing, means for displacing the work engaging jaw from a first position whereat the workpiece bearing will be forcefully clamped intermediate the base member and the jaw whereby rotation of the chuck will effect rotation of the workpiece, to a second position whereat the workpiece can be displaced relative to the base member and the jaw, at least one air pocket in the base member bearing surface, and means for directing pressurized fluid to the air pocket whereby when the jaw is at the second position the force required to displace the workpiece relative to the base member and the jaw will be reduced.

3 Claims, 7 Drawing Figures

Fig_1
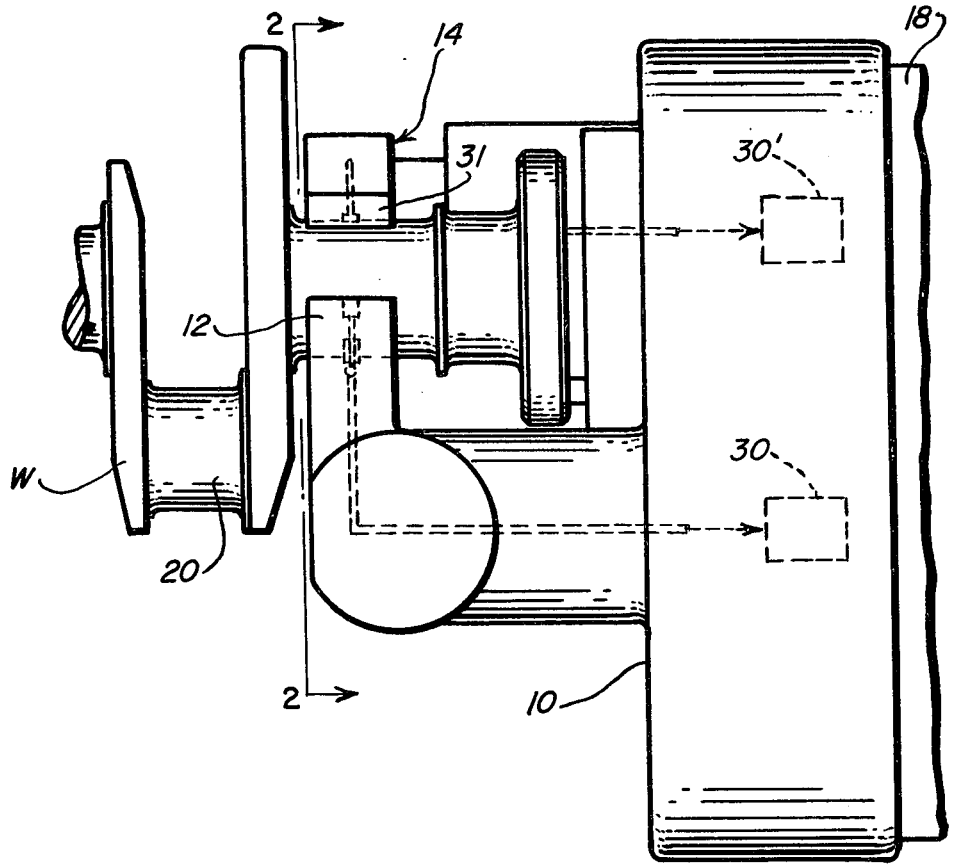
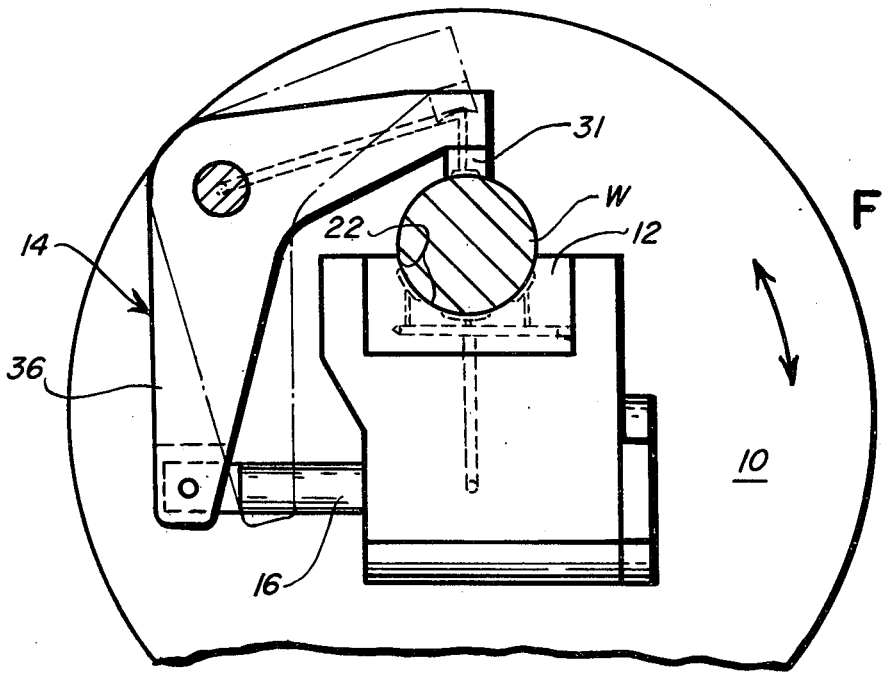
Fig_2

CHUCK ASSEMBLY

This is a continuation, of application Ser. No. 390,248 filed Aug. 21, 1973, and has abandoned.

This invention relates to grinding machines and particularly to throw blocks for crankpin grinding machines.

Grinding machines for grinding crankpins include a machine bed having a work carriage mounted on the bed for longitudinal movement along the length of the bed. A crankshaft to be ground is supported at either end between a throw block and one or more flat-faced clamp pads which are mounted in respective machine chucks.

The end main bearings of the crankshaft are supported by the throw blocks and their related clamp pads with the axis of the main bearings offset from the axis of rotation of the chucks by an amount corresponding to the throw of the crankshaft, with the crankpin to be ground in axial alignment with the chuck axis so that the crankshaft rotates about the axis of that crankpin.

When a further crankpin is to be ground it is necessary to rotate the crankshaft relative to the chuck to bring the next crankpin into a correct radial position in axial alignment with the chuck axis. This movement is often referred to as "rotary indexing".

The torque required to radially index the shaft, i.e., rotate the shaft in the throw blocks to axially align another crankpin, increases as the size and weight of the crankshaft increases, owing to the frictional resistance between the crankshaft main bearing and the throw block. It is desirable to minimize the torque required, to facilitate rotation of the crankshaft and reduce wear.

It is accordingly an object of the present invention to at least partially support the main crankshaft bearings on a pressurized air bed during rotary indexing or during "spark splitting" (lateral positioning of a crankshaft to equalize grinding wheel cut on the side wall portions of the crankpin to be ground).

An advantage of the present invention is that since at least a portion of the crankshaft weight is supported upon an air film, there is a substantial reduction in wear on the bearing surfaces of the throw blocks during rotary indexing or spark splitting which prolongs their life and in this way improves the precision with which crankpins will be ground.

A further advantage of the present invention is that with both ends of the crankshaft being at least partially supported on air bearings, the friction forces between the crankshaft and the throw block bearing surfaces are considerably reduced and hence, the manual or automatic power required for rotary indexing or spark splitting is considerably reduced.

Another advantage of reducing friction between crankshaft and throw block and/or clamp pad is that damage or wear on the surface of the crankshaft location journal during radial indexing and/or lateral location is minimized. In some cases this is particularly important since the location journal may already be finish ground and must not be damaged.

A further advantage is that escaping air, from the air bearing during rotation of the crankshaft relative to the throw block, also minimizes the possibility of ingress of dirt, coolant, etc., contaminating the location surface of the throw block and clamp pad during the repositioning of the crankshaft when relocating.

Additional objects and advantages of the present invention will become apparent from the following portion of this specification and from the accompanying drawings which illustrate, in accordance with the mandate of the patent statutes presently preferred embodiments incorporating the principles of the invention.

Referring to the drawings:

FIG. 1 is a fragmentary view of a crankshaft held between a throw block and clamp pad of a grinding machine chuck;

FIG. 2 is a sectional elevation along lines 2—2 of FIG. 1;

Figure 3:
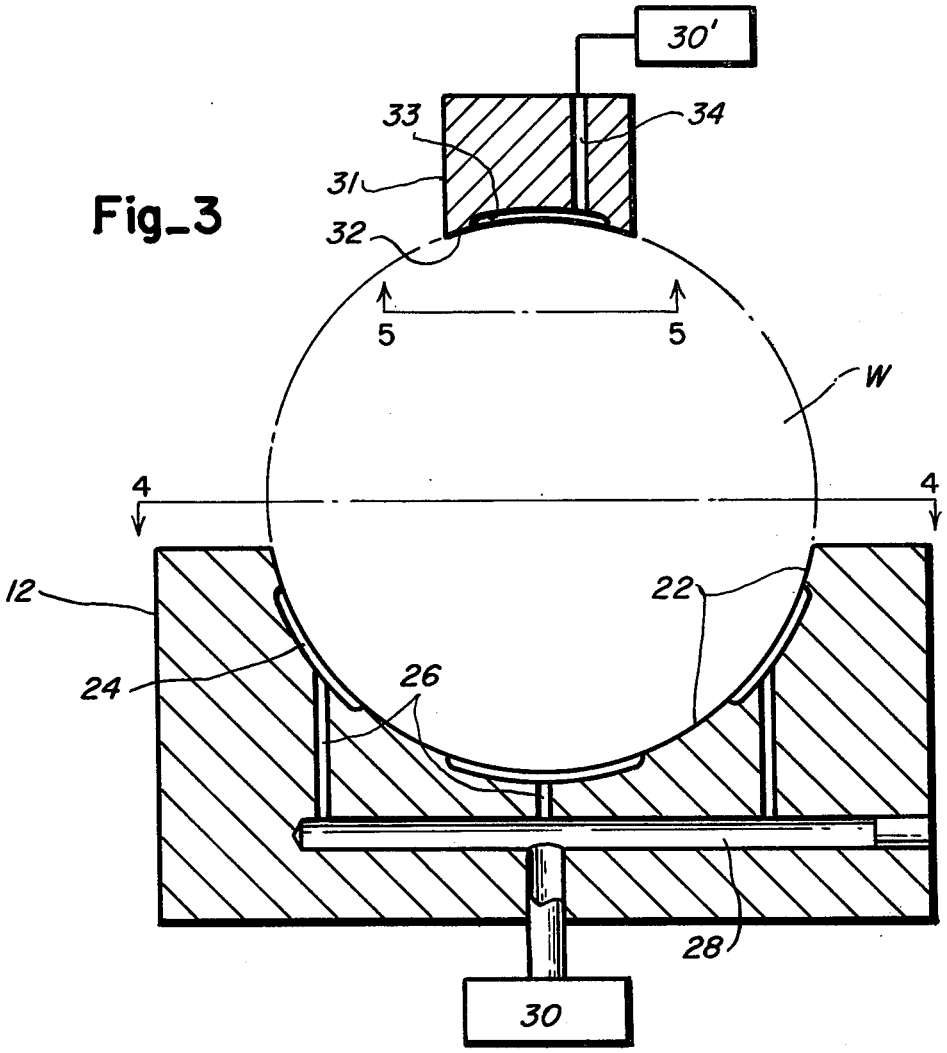
FIG. 3 is an enlarged view partly in section of the throw block and single clamp pad illustrated in FIG. 2.
Figure 4:
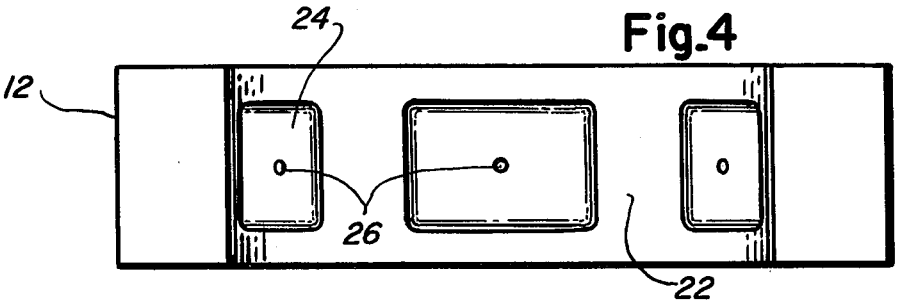
FIG. 4 is a view taken along lines 4—4 of FIG. 3.

a. the torque required to rotate the crankshaft, b. the lateral force needed for crankshaft axial movement, and c. the crankshaft lift, all to a base of air pressure.

A crank carrying fixture or chuck assembly for supporting one of the end bearings of a crankshaft W is illustrated in FIGS. 1 and 2. The chuck assembly includes a fixture 10, a throw or bearing block 12 which is mounted on the fixture and at least one jaw member or clamp 14 which is secured to the fixture for selective pivotal displacement by a selectively actuatable hydraulic cylinder or the like 16 from a first position illustrated in FIG. 2 where the crankshaft W end bearing is clamped intermediate the throw block 12 and jaw 14 to a second position illustrated by the dotted line representation in FIG. 2 where the workpiece may be freely displaced relative to the throw block or jaw.

The chuck is conventionally mounted on a crankhead 18 which rotatively drives the chuck and the clamped crankshaft about the axis of the crankhead and one of the crankshaft crankpins 20, which is axially aligned with the spindle axis, is ground to size by a grinding wheel (not shown) in a known manner.

Once a crankpin 20 has been ground to size, the crankshaft W is radially indexed without stopping the rotation of the crankshaft to axially align another crankpin in a known manner. Radially indexing without stopping the rotation of the crankshaft, which is known as "indexing on the fly," is described in U.S. Pat. No. 3,118,258, and involves displacing the clamp 14 a predetermined small amount towards its retracted or third position which is just sufficient to allow the crankshaft W to rotate relative to the throw block and then rotating the crankshaft relative to the throw block and its associated clamp.

The throw block 12 (FIG. 3) includes a semi-cylindrical bearing surface 22 which is selectively configured to mate with one of the end main bearings of the crankshaft. The bearing surface 22, which extends approximately 160° around the periphery of the crankshaft end bearing, includes three air pockets 24 circumferentially spaced therearound, each of which is supplied with air through individual passages 26 from a common feed conduit 28. The common feed conduit is connected either continuously or only during rotary indexing and spark splitting through a selectively operable control valve (not shown) to a source of pressurized fluid such as air 30.

Figure 5:
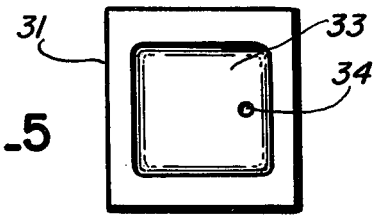
FIG. 5 is a view taken along lines 5—5 of FIG. 3.

One or more work energizing jaws 14 are associated with each throw block and the clamp pad 31 of each of these jaws is preferably profiled to mate with the curvature of the crankshaft journal bearing being clamped. As is illustrated in FIGS. 3 and 5, the clamp pad 31 is of generally cuboid configuration with one side of the cube being arcuate and profiled to the radius of the end main bearing of the crankshaft. The arcuate bearing surface 32 is provided with an air pocket 33 which is connected to a source of pressurized air 30' through a suitable passage 34.

The clamp pad 31 is carried on one end of a clamp arm 36 which is in the form of a bell crank. The other end of the clamp arm is reciprocable by means of the hydraulic cylinder 16.

Figure 6:
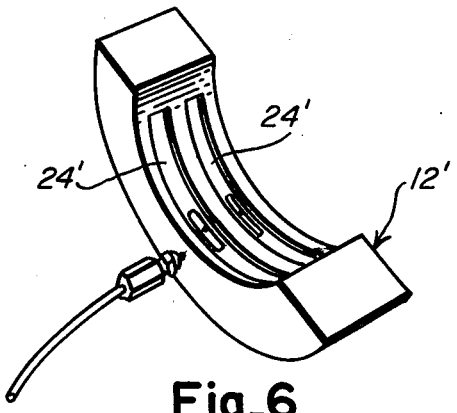
FIG. 6 is a perspective view of a throw block having an alternative air pocket configuration.

The throw block 12' illustrated in FIG. 6, is of generally arcuate configuration and includes a pair of grooves or channels 24' which are machined into the bearing surface. While two channels are illustrated, it has been found that one channel is sufficient to raise and support the crankshaft.

Figure 7:
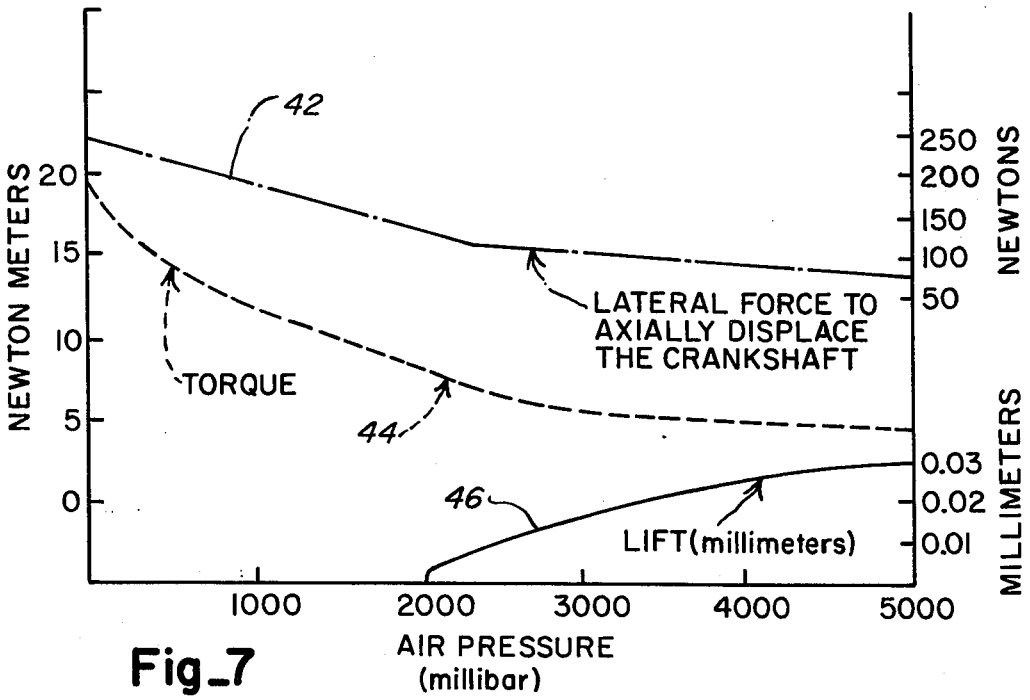
FIG. 7 is a plot illustrating.

The plot of FIG. 7 consists of three graphs designated 42, 44 and 46 each plotted to a base of air pressure. The results were obtained using a 210 lb. crankshaft supported in a test rig. Graph 42 is of the force required to commence axial movement of the crankshaft. It will be seen that as the air pressure increases and the crankshaft starts to float on an air cushion, the force required to effect initial movement of the crankshaft decreases from about 240 Newtons to about 75 Newtons.

Graph 44 illustrates the torque required to be applied to the crankshaft to continue rotation once initial rotation had commenced. Again, it will be observed that the torque required falls steadily from approximately 19 Newtons until the crankshaft began to "float" on an air cushion when the force required steadied at approximately 45 Newtons.

Graph 46 shows the lift or separation of the crankshaft from the throw block bearing. As the separation of the crankshaft from the throw block bearing increases, the stability of the crankshaft decreases. Accordingly, the use of the clamp pad air pocket 33, in conjunction with the throw block air pockets, will, in those situations where the throw block is stopped in the orientation illustrated in FIGS. 1 and 2, maintain the continued stability of the crankshaft as air pressure from the source through conduits 26 is increased.

In those situations where the throw block will stop in a random orientation, the presence of the air pocket in the clamp pad 31 in combination with the plurality of circumferentially spaced air pockets in the throw block, will additionally assure that the crankshaft bearing will be at least partially supported by the pressurized air regardless of orientation.

Having thus disclosed my invention, what I claim is:

1. A chuck assembly for rotatably supporting a bearing of a workpiece comprising a clamping fixture including a throw block having a bearing surface selectively configured for matingly supporting a first portion of the workpiece bearing, a jaw having a selectively configured bearing surface for matingly engaging another portion of the workpiece bearing when a workpiece bearing is clamped between said throw block and said jaw, means for displacing said jaw prior to a machining operation from a retracted position spaced from said another portion to a clamping position, and means for urging the workpiece bearing, matingly supported by said throw block bearing surface away therefrom including, at least one air pocket in said throw block bearing surface, a source of pressurized air, and means for directing pressurized air from said source to a closed volume which is defined by said air pocket and the first workpiece bearing portion when said jaw is displaced to said retracted position, whereby the force required to displace the workpiece relative to said throw block and said jaw will be reduced.

2. A chuck assembly for rotatably supporting a bearing of a workpiece according to claim 1, further comprising at least one air pocket in said jaw bearing surface and means for directing pressurized air to said air pocket when said jaw is at said retracted position.

3. A chuck for rotatably supporting a bearing of a workpiece according to claim 1, further comprising a plurality of air pockets in said throw block.

* * * * *